US005462387A

United States Patent [19]

Roth

[11] Patent Number: 5,462,387

[45] Date of Patent: Oct. 31, 1995

[54] CONCRETE BREAKING APPARATUS

[76] Inventor: Scott R. Roth, 848 Hidden Hills Dr., Bellevue, Nebr. 68005

[21] Appl. No.: 328,102

[22] Filed: Oct. 24, 1994

[51] Int. Cl.[6] ..... E01C 23/00

[52] U.S. Cl. ..... 404/90

[58] Field of Search ..... 404/90, 91, 114, 404/117; 299/36, 39

[56] References Cited

U.S. PATENT DOCUMENTS

| | | | |
|---|---|---|---|
| 3,950,110 | 4/1976 | Clifford | 404/124 |
| 3,966,346 | 6/1976 | Berrange | 404/124 |
| 4,147,448 | 4/1979 | Jeffery | 404/124 |
| 4,573,826 | 3/1986 | Piovesan | 404/90 |
| 4,909,575 | 3/1990 | Lupton | 404/90 X |

*Primary Examiner*—Michael Powell Buiz

*Attorney, Agent, or Firm*—Zarley, McKee, Thomte, Voorhees & Sease; Mark D. Frederiksen

[57] ABSTRACT

A concrete breaking apparatus includes a non-circular multi-lobed impact roller connected via an axle to a wheeled frame such that the roller rolls upon the ground as the frame is towed by a tractor. Each lobe of the roller includes a ridge extending across the width of the roller and projecting outwardly from the impact surface of each lobe along a line parallel to the axle and generally centrally located within the dynamic impact region of the impact surface. The ridge may take various configurations, including a triangular cross-section, a semi-circular cross-section, and a plurality of spaced apart projections.

8 Claims, 3 Drawing Sheets

CONCRETE BREAKING APPARATUS

TECHNICAL FIELD

The present invention relates generally to apparatus for breaking concrete, and more particularly to an improved concrete breaking apparatus utilizing a modified impact roller.

BACKGROUND OF THE INVENTION

In the repair and reconstruction of streets and highways, it is typically necessary to remove the existing concrete and prepare the underlying surface for new concrete. The process for breaking up hardened concrete is typically quite time consuming, thereby slowing down the entire reconstruction project.

Prior art apparatus for breaking up concrete includes large high density balls which are dropped on the concrete to break it in small pieces, and "guillotines" which utilize a heavy weight with a sharpened lower end which is driven downwardly by gravity on a pair of rails to drive a wedge into the concrete. When a guillotine is used, the wedge must typically be dropped a number of times in order to effect the splitting and breaking apart of the concrete. Other methods available for breaking concrete include the use of jack hammers and the like. Again, such apparatus and methods are typically very slow.

SUMMARY OF THE INVENTION

It is therefore a general object of the present invention to provide an improved concrete breaking apparatus.

Another object is to provide a concrete breaking apparatus which will break concrete more quickly than prior art apparatus.

Still another object is to provide a concrete breaking apparatus which will break the concrete into small easily removable pieces.

These and other objects will be apparent to those skilled in the art.

The concrete breaking apparatus of the present invention includes a non-circular multi-lobed impact roller connected via an axle to a wheeled frame such that the roller rolls upon the ground as the frame is towed by a tractor. Each lobe of the roller includes a ridge extending across the width of the roller and projecting outwardly from the impact surface of each lobe along a line parallel to the axle and generally centrally located within the dynamic impact region of the impact surface. The ridge may take various configurations, including a triangular cross-section, a semi-circular cross section, and a plurality of spaced apart projections.

DESCRIPTION OF THE PREFERRED EMBODIMENT

Figure 1:
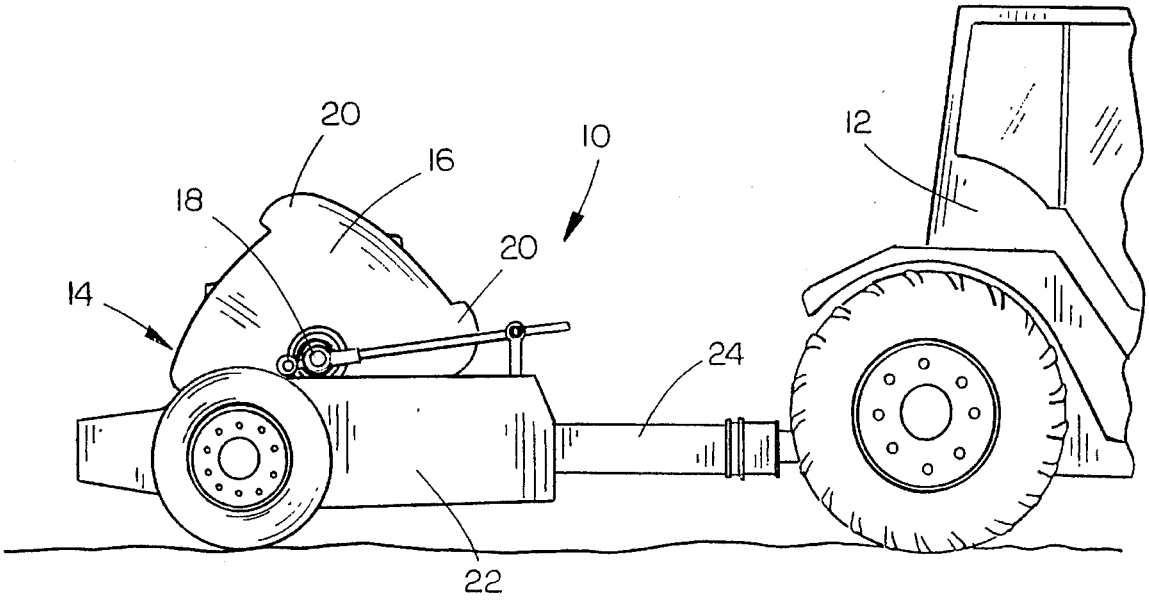
FIG. 1 is a side elevational view of the concrete breaking apparatus of the present invention towed by a tractor.

Referring now to the drawings, in which similar or corresponding parts are identified with the same reference numeral, and more particularly to FIG. 1, the concrete breaking apparatus of the present invention is designated generally at 10 and is shown being towed behind a tractor 12.

Concrete breaking apparatus 10 is essentially a modification to a conventional compaction roller assembly such as that described in U.S. Pat. No. 4,147,448 to Brian S. Jeffery. The conventional compaction roller assembly 14 includes a multi-lobed non-circular impact roller 16 having a rotational axis 18 and 4 lobes 20. Impact roller 16 is mounted rotatably on a wheeled frame 22, with a forwardly projecting tongue 24 removably connected to tractor 12.

Figure 2:
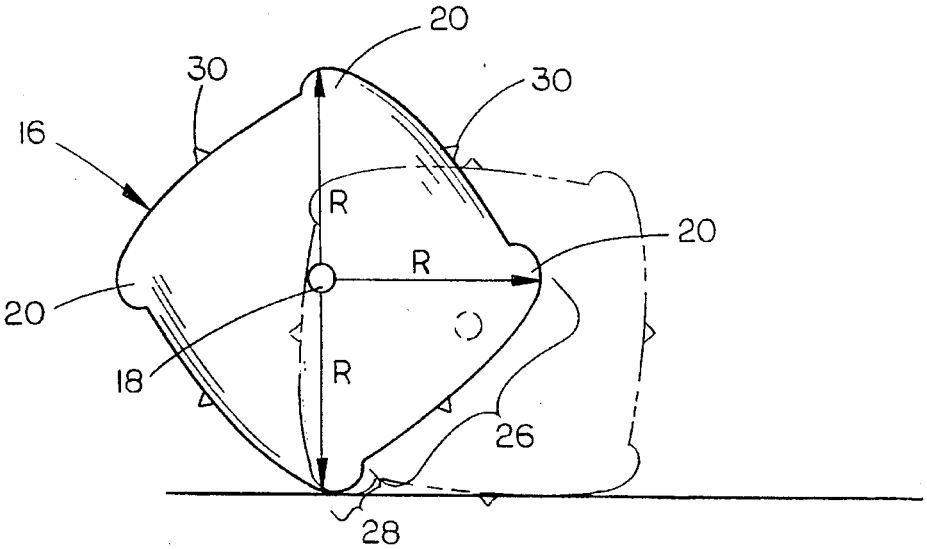
FIG. 2 is an enlarged side elevational view of the impact roller showing two positions of the roller.

Referring now to FIG. 2, the conventional impact roller 16 includes 4 lobes 20 spaced at 90° from one another relative to axis 18 and having a maximum radius R. Each lobe 20 includes an impact surface 26 curved along a large radius and a following surface 28 curved on a shod radius.

The conventional compaction roller assembly described in U.S. Pat. No. 4,147,448 is utilized to compact soil by rolling the impact roller along the ground. The conventional impact roller weighs over 30,000 pounds, and is preferably rolled at a speed of 7–9 miles per hour, causing 2 lobes of the roller to strike the ground each second. Each lobe causes the rotational axis to rise relative to the ground, thereby causing a larger dynamic impact force along the impact surface of each lobe. It is estimated that the impact force along the entire impact surface is approximately 22,000 foot pounds when the compaction roller assembly is at the suggested velocity.

While the conventional compaction roller assembly is quite effective in compacting soil, the inventor has found that the addition of a projecting ridge 30 oriented in the center of the impact surface 26 of the impact roller 16 provides a dynamic force capable of breaking up concrete up to 12 inches thick.

Figure 3:
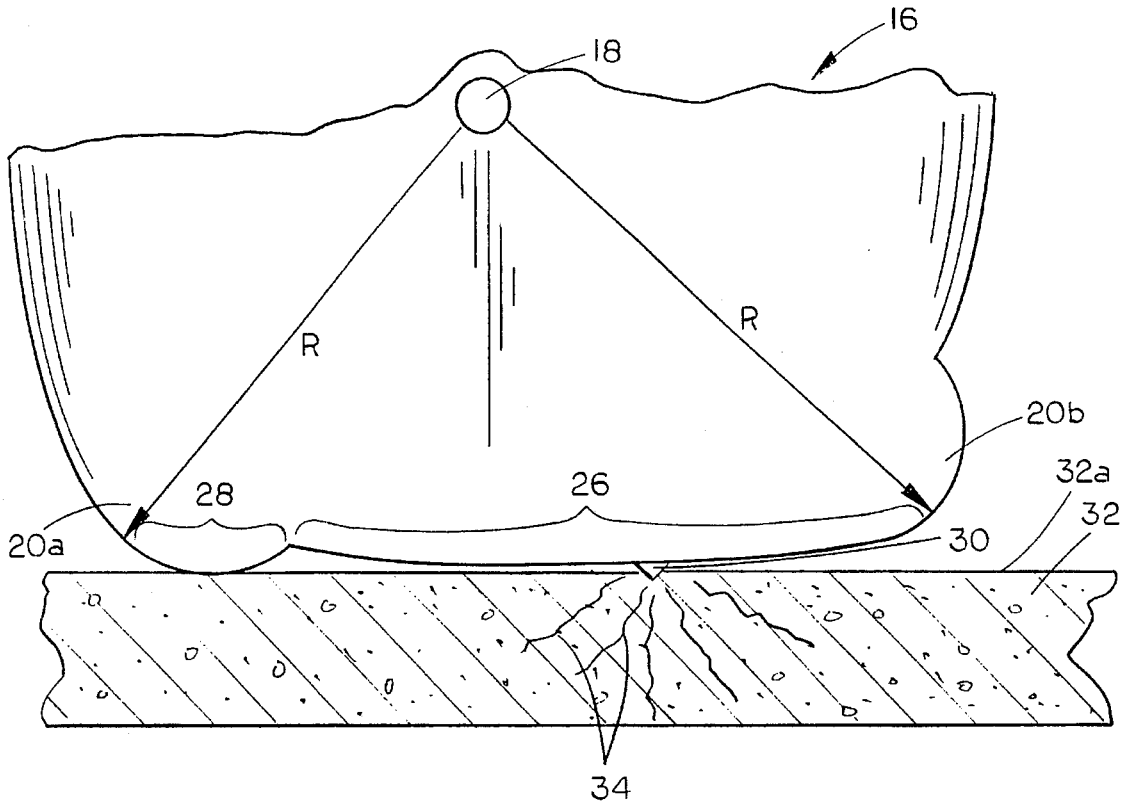
FIG. 3 is a super enlarged view of the impact roller contacting a section of concrete.
Figure 4:
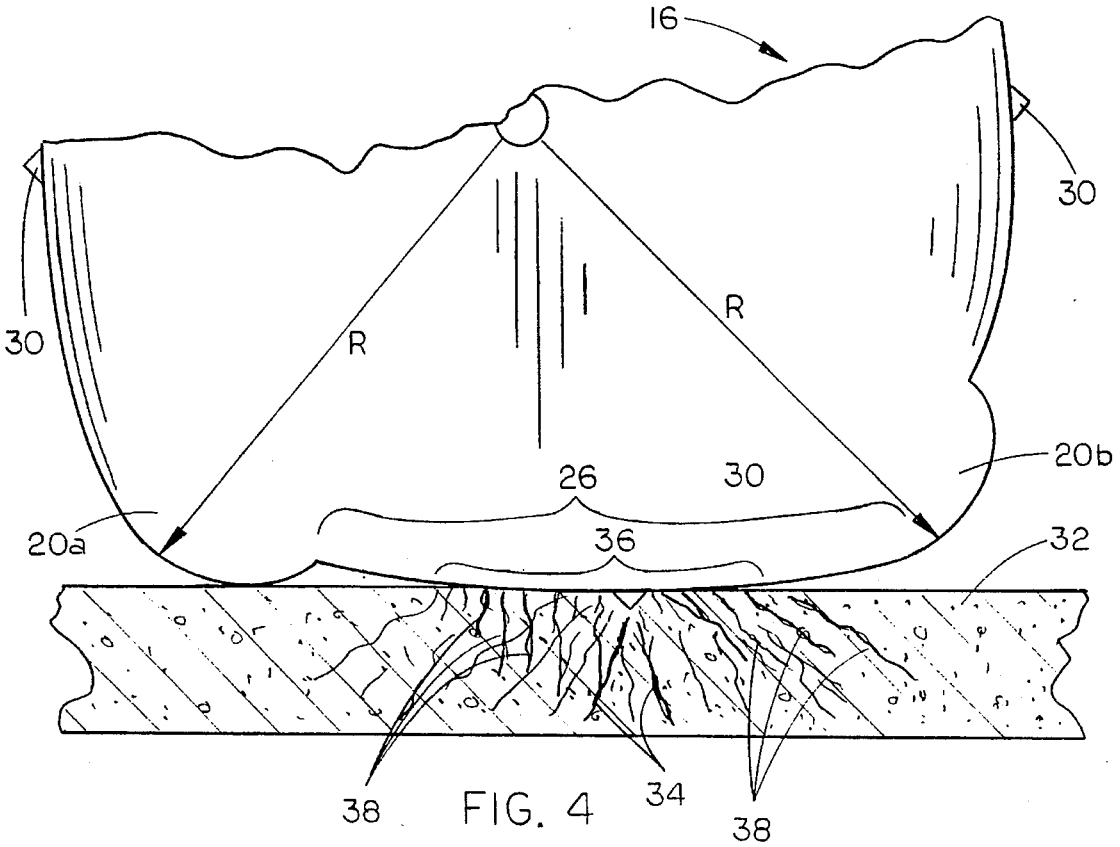
FIG. 4 is a view similar to FIG. 3 but with the impact roller rotated an additional distance.

Referring now to FIG. 3, impact roller 16 is shown as it rolls from lobe **20*a* to lobe 20*b*. Ridge 30 is a solid triangular bar welded to the impact surface 26 of impact roller 16 and oriented parallel to the rotational axis 18 of impact roller 16. As shown in FIG. 3, ridge 30 is located centrally on the impact surface such that ridge 30 is the first portion of impact roller 16 which contacts the upper surface 32*a* of concrete 32. Because of the dynamic force applied along ridge 30, it has been found that concrete up to 12 inches thick will be caused to crack, as shown by crack lines 34. FIG. 4 shows impact roller 16 continuing to roll from lobe 20*a* to lobe 20*b*, wherein ridge 30 is driven into the concrete 32 such that a much greater surface area of impact surface 26 actually contacts concrete 32. The region of impact surface 26 which provides a dynamic blow to concrete 32 is identified as the dynamic impact region (DIR) 36. DIR 36 extends the width of impact roller 16 and a length approximately ½ to ¾ of the length of impact surface 26. DIR 36 is generally centered within the length of impact surface 26**.

As shown in FIG. 4, the force applied by DIR 36 causes a more extensive region of smaller cracks 38 to develop in concrete 32 surrounding major crack lines 34. It can therefore be seen that a number of passes of roller 16 will cause the complete break up of concrete 32. In addition, since the concrete breaking apparatus 10 is moved along the surface of the concrete between 7 and 10 miles per hour, the speed at which the concrete is broken up is exponentially greater than the speed at which conventional methods break up the concrete.

Figure 5:
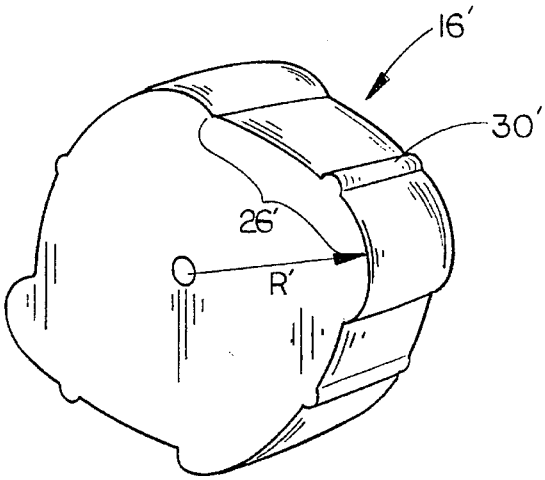
FIG. 5 is a perspective view of a second embodiment of the impact roller.

Referring now to FIG. 5, a second embodiment of the impact roller is designated generally at 16' and is identical to roller 16 of FIG. 4 except for the construction of ridge 30'. As shown in FIG. 5, ridge 30' has a semi-circular cross-section rather than the triangular cross-section of ridge 30 of the first embodiment. Preferably, ridge 30' extends the entire width of roller 16'.

Figure 6:
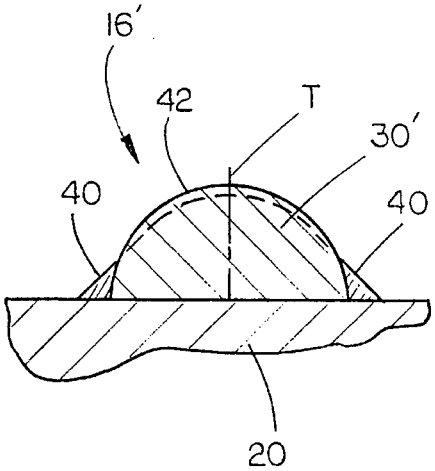
FIG. 6 is an enlarged sectional view through one projection on a lobe of the roller of FIG. 5.

FIG. 6 is a cross-sectional view through one ridge 30' of impact roller 16', showing the semi-circular cross-section thereof. Ridge 30' is preferably spot welded along the longitudinal edges thereof with welds 40. The surface 42 of each ridge 30' is preferably heat treated. Because the hardened heat treated steel is more difficult to weld to the roller proper, the heat treated surface is limited to approximately one-half of the surface of ridge 30', extending from the point T projecting the greatest distance from the lobe 20 of the roller 16'.

Figure 7:
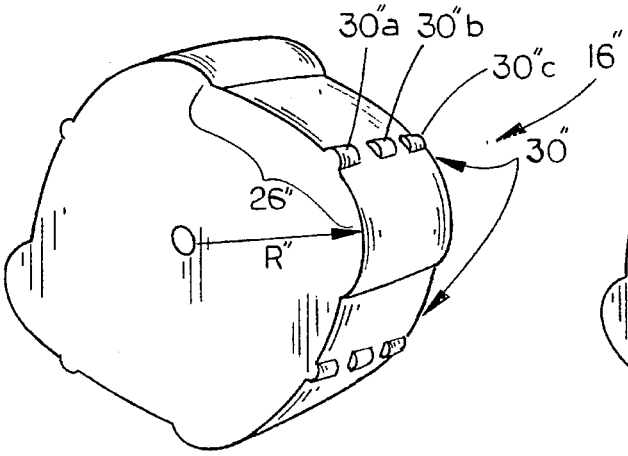
FIG. 7 is a perspective view of a third embodiment of the impact roller.

FIG. 7 shows a third embodiment of impact roller 16" utilizing a non-continuous ridge 30" mounted on the impact surface 26" of roller 16". Each ridge 30" includes three semi-circular rods 30"*a*, 30"*b*, and 30"*c* mounted to impact surface 26 along a line centered within the impact area and spaced apart across the width of impact roller 16". While ridge elements 30"*a*, *b* and *c* are shown as semi-cylindrical, other configurations are equally effective.

Figure 8:
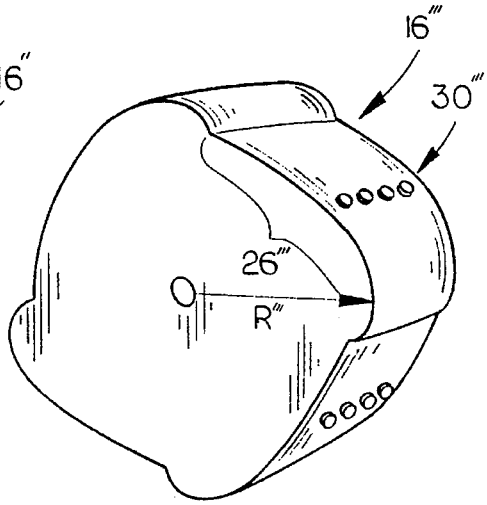
FIG. 8 is a perspective view of a fourth embodiment of the impact roller.

FIG. 8 shows a fourth embodiment of the impact roller 16''' with yet another configuration of ridge 30'''. As can be seen in the drawings, a plurality of cylindrical projections 42 are mounted to the impact surface 26 along a line centered in impact area 26'''and spaced apart across the width of impact roller 16'''. While projections 42 are shown as cylindrical, other configurations of the projections are equally effective.

Whereas the invention has been shown and described in connection with the preferred embodiments thereof, many modifications, substitutions and additions may be made which are within the intended broad scope of the appended claims.

I claim:

1. A concrete breaking apparatus comprising:

a non-circular multi-lobed impact roller connected via an axle to a frame so as to follow the frame when the frame is propelled;

each lobe of the roller including an impact surface with a dynamic impact region which intermittently contacts the ground as the roller rotates on the frame; and a ridge projecting outwardly from the impact surface of each lobe and oriented along a line parallel to the axle and centrally within the dynamic impact region.

2. The concrete breaking apparatus of claim 1, wherein each said ridge has a solid member having a triangular cross-section.

3. The concrete breaking apparatus of claim 1, wherein each said ridge is a solid member having a semi-circular cross-section.

4. The concrete breaking apparatus of claim 2, wherein each said ridge extends continuously across the width of the roller.

5. The concrete breaking apparatus of claim 3, wherein each said ridge extends continuously across the width of the roller.

6. The concrete breaking apparatus of claim 1, wherein each said ridge comprises a plurality of spaced apart solid projections.

7. The concrete breaking apparatus of claim 6, wherein said projections are each generally cylindrical with an axis oriented perpendicular to the roller surface.

8. A method for breaking concrete, comprising:

affixing a projecting ridge to each impact surface of each lobe of a non-circular multi-lobed impact roller;

said impact roller of the type rotatably mounted on an axle connected to a frame; and moving the frame over a predetermined area of concrete such that each ridge impacts upon the concrete as the roller rotates on its axle.

* * * * *